US007497693B1

(12) United States Patent
Wu

(10) Patent No.: US 7,497,693 B1
(45) Date of Patent: Mar. 3, 2009

(54) ELECTRICAL INTERCONNECTION SYSTEM USING MAGNETIC RETENTION

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/998,539

(22) Filed: Nov. 30, 2007

(51) Int. Cl.
*H01R 11/30* (2006.01)

(52) U.S. Cl. ..... 439/39

(58) Field of Classification Search ..... 439/38–40
See application file for complete search history.

(56) References Cited

U.S. PATENT DOCUMENTS

| | | | | |
|---|---|---|---|---|
| 3,144,527 | A * | 8/1964 | Tolegian | 439/38 |
| 3,792,208 | A * | 2/1974 | Meyer | 250/551 |
| 3,808,577 | A * | 4/1974 | Mathauser | 439/39 |
| 4,500,881 | A * | 2/1985 | Beane | 439/38 |
| 5,921,783 | A * | 7/1999 | Fritsch et al. | 439/38 |
| 5,954,520 | A * | 9/1999 | Schmidt | 439/39 |
| 6,749,467 | B2 * | 6/2004 | Korsunsky et al. | 439/38 |
| 7,204,695 | B1 * | 4/2007 | Shiu et al. | 439/38 |
| 7,217,142 | B1 | 5/2007 | Wu | |
| 7,247,046 | B1 | 7/2007 | Wu | |
| 7,329,128 | B1 * | 2/2008 | Awad et al. | 439/38 |
| 2007/0072443 | A1 | 3/2007 | Rohrbach et al. | |

* cited by examiner

*Primary Examiner*—Briggitte R Hammond
(74) *Attorney, Agent, or Firm*—Wei Te Chung

(57) ABSTRACT

An electrical interconnection system has a plug connector (1) and receptacle connector (2). The plug connector (1) includes an insulated housing (13); a number of terminals (12) received in the insulated housing (13), said the contacts being separated into two distinct sets along longitudinal direction and apart from one another vertically; an attraction member (1) assembled to the insulated housing. The receptacle connector (2) includes an insulative housing; a number of contacts (24) separated into two distinct sets along vertical direction and received in the insulative housing; a magnetic block (22) assembled to the insulative housing. The plug connector (1) and the receptacle connector (2) are securely coupled together via a magnetic attraction between the magnetic member and the attraction member thereof. The contacts of the receptacle connector contact the terminals of the plug connector, respectively.

19 Claims, 10 Drawing Sheets

ELECTRICAL INTERCONNECTION SYSTEM USING MAGNETIC RETENTION

CROSS-REFERENCE TO RELATED APPLICATION

This application is related to patent application Ser. No. 11/982,636, filed on Nov. 2, 2007, entitled "ELECTRICAL CONNECTOR ASSEMBLY WITH MAGNETIC RETENTION DEVICE", and it has the same applicant and assignee as the present invention. The disclosure of the related application is incorporated herein by reference.

BACKGROUND OF THE INVENTION

1. Field of the Invention The present invention generally relates to an electrical interconnection system, and more particularly to an electrical interconnection system using magnetic attraction as retention means.

2. Description of Related Art

An electrical interconnection system is widely applied in electronic devices for signal transmission or power delivery. In order to prevent mated electrical connectors of the electrical interconnection system from being separated away from each other when they are in working status, a mechanism latch device is used to retain them together. However, the latch device may deform if it is improperly used or some other reasons, thus the latch device couldn't ensure that the mated electrical connectors are coupled together securely.

U.S. Pat. Pub. No. 20070072443 disclose an electrical plug and receptacle relying on magnetic force to maintain contact. The plug and receptacle can be used as part of a power adapter for connecting an electronic device, such as a laptop computer, to a power supply. The plug includes electrical contacts, which are preferably biased toward corresponding contacts on the receptacle. The plug and receptacle each have a magnetic element. The magnetic element on one or both of the plug and receptacle can be a magnet, which is preferably a permanent rare earth magnet although electromagnets may also be used. The magnetic element on the plug or receptacle that does not include a magnet is composed of ferromagnetic material. When the plug and receptacle are brought into proximity, the magnetic attraction between the magnet and its complement, whether another magnet or a ferromagnetic material, maintains the contacts in an electrically conductive relationship. However, the plug or the receptacle only has a row of contacts, and an electrical connector has two rows or more rows of contacts are needed in some applications.

Hence, an improved electrical interconnection system is highly desired to overcome the disadvantages of the related art.

SUMMARY OF THE INVENTION

Accordingly, an object of the present invention is to provide an electrical interconnection system using a magnetic device as retention means.

In order to achieve the object set forth, an electrical interconnection system in accordance with the present invention comprises a plug connector and a receptacle connector. The plug connector includes an insulated housing; a number of terminals received in the insulated housing, said the terminals arranged in two rows; an attraction member assembled to the insulated housing. The receptacle connector mated to the plug connector, includes an insulative housing; a number of contacts received in the insulated housing, said the contacts arranged in two rows, mating with the terminals of the plug connector respectively; a magnetic block assembled to the insulative housing. The plug connector and the receptacle connector are securely coupled together via a magnetic attraction between the magnetic member and the attraction member thereof.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
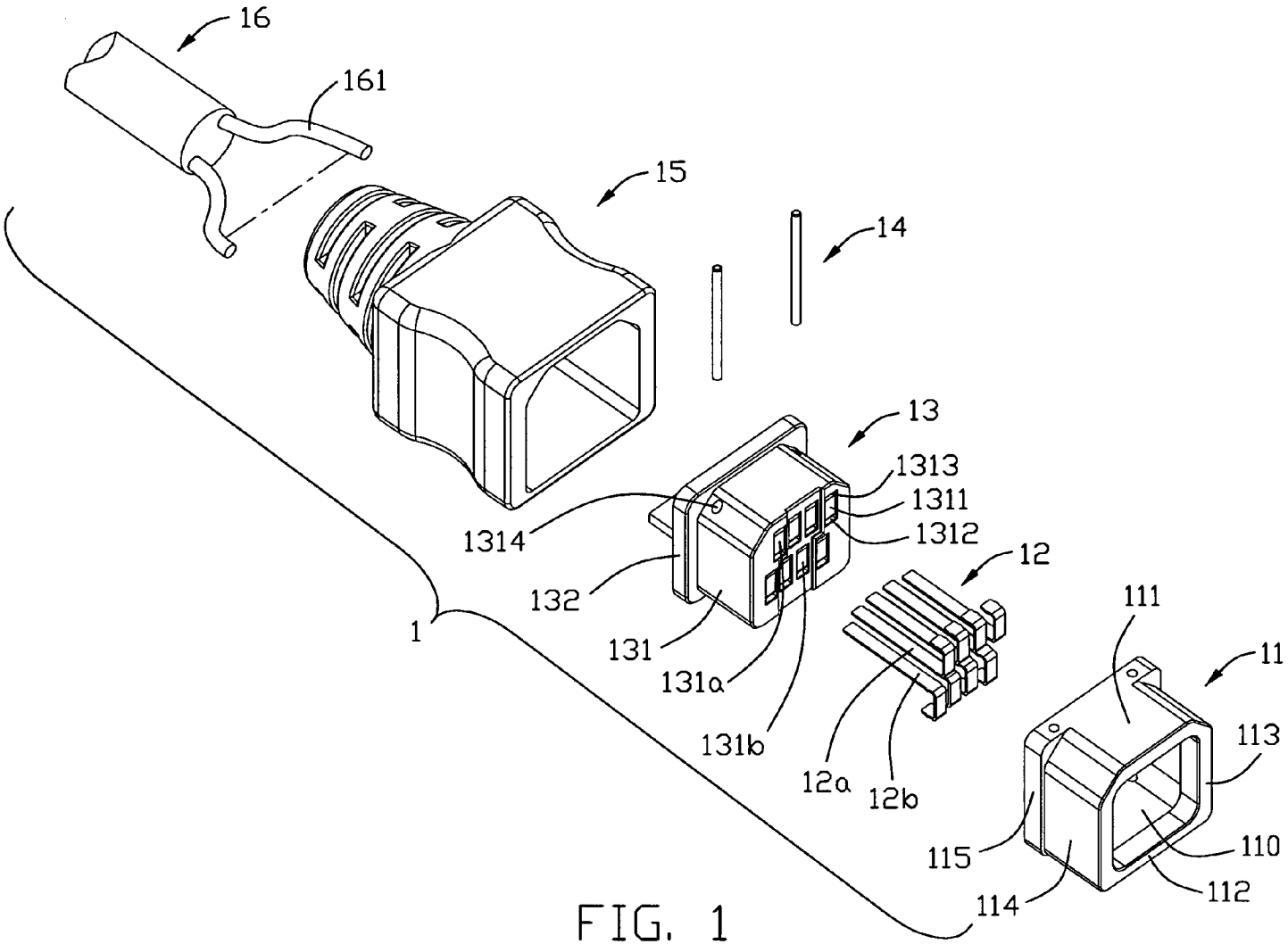
FIG. 1 is an exploded, perspective view of the plug connector for electrical interconnection system in accordance with the present invention.
Figure 2:
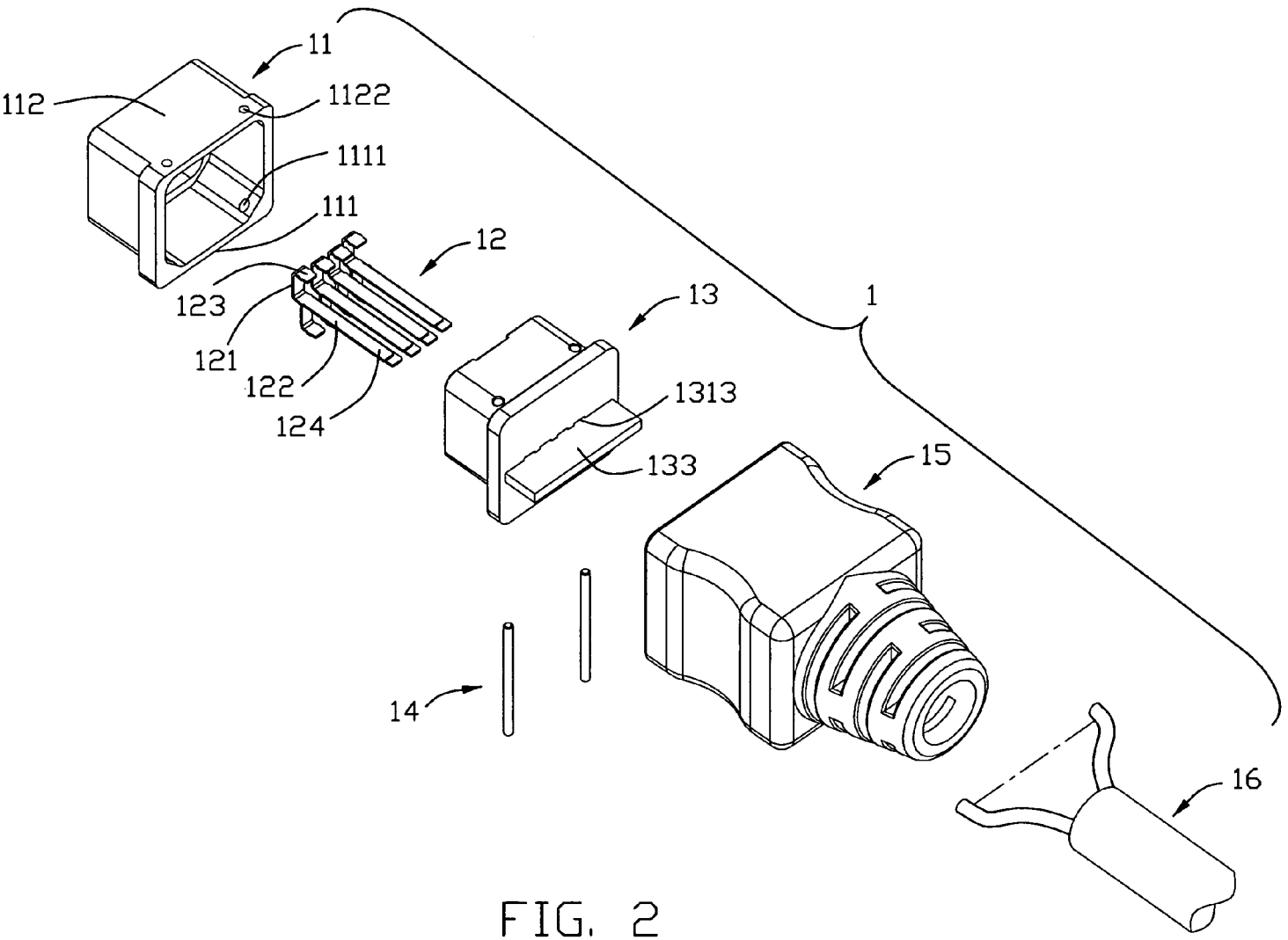
FIG. 2 is a view similar to FIG. 1, but viewed from another aspect.
Figure 3:
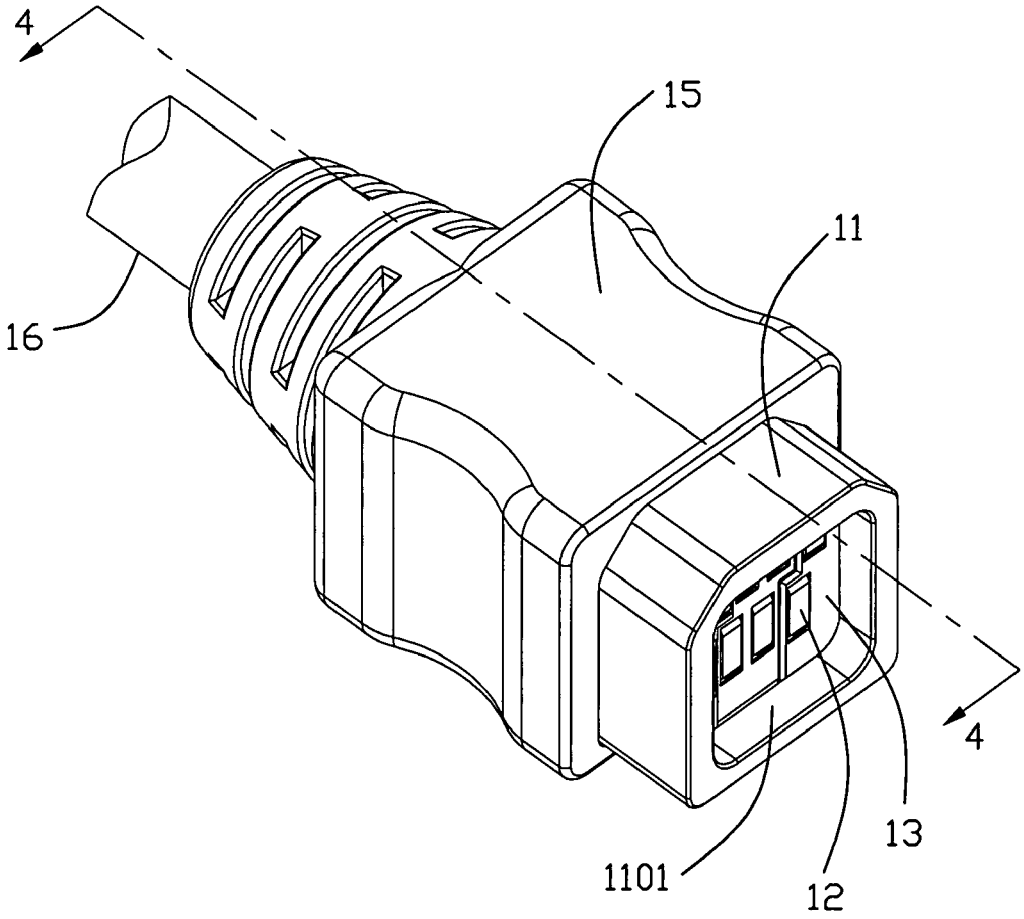
FIG. 3 is an assembled, perspective view of the plug connector shown in FIG. 1.
Figure 4:
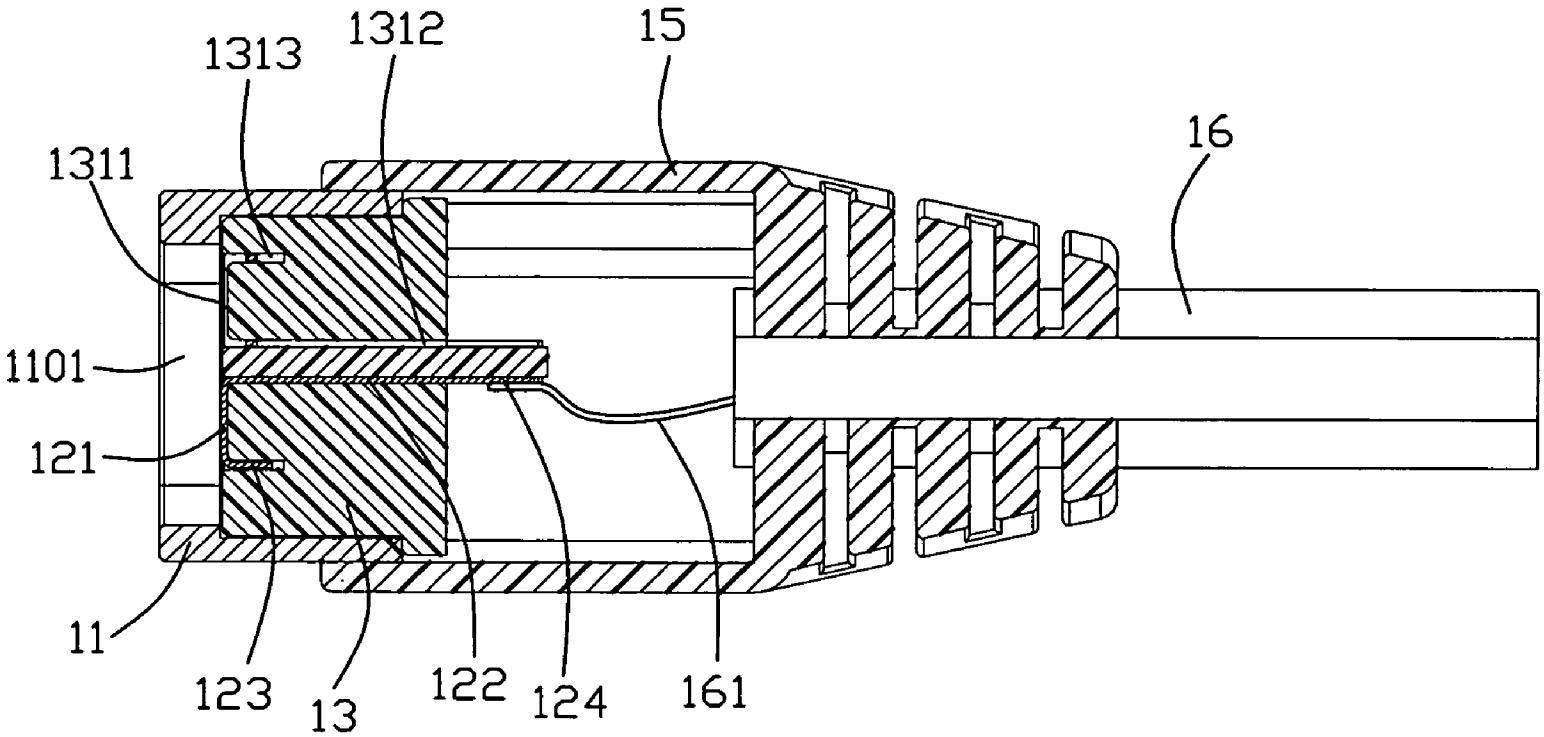
FIG. 4 is a cross-section view taken along line 4-4 of FIG. 3.
Figure 5:
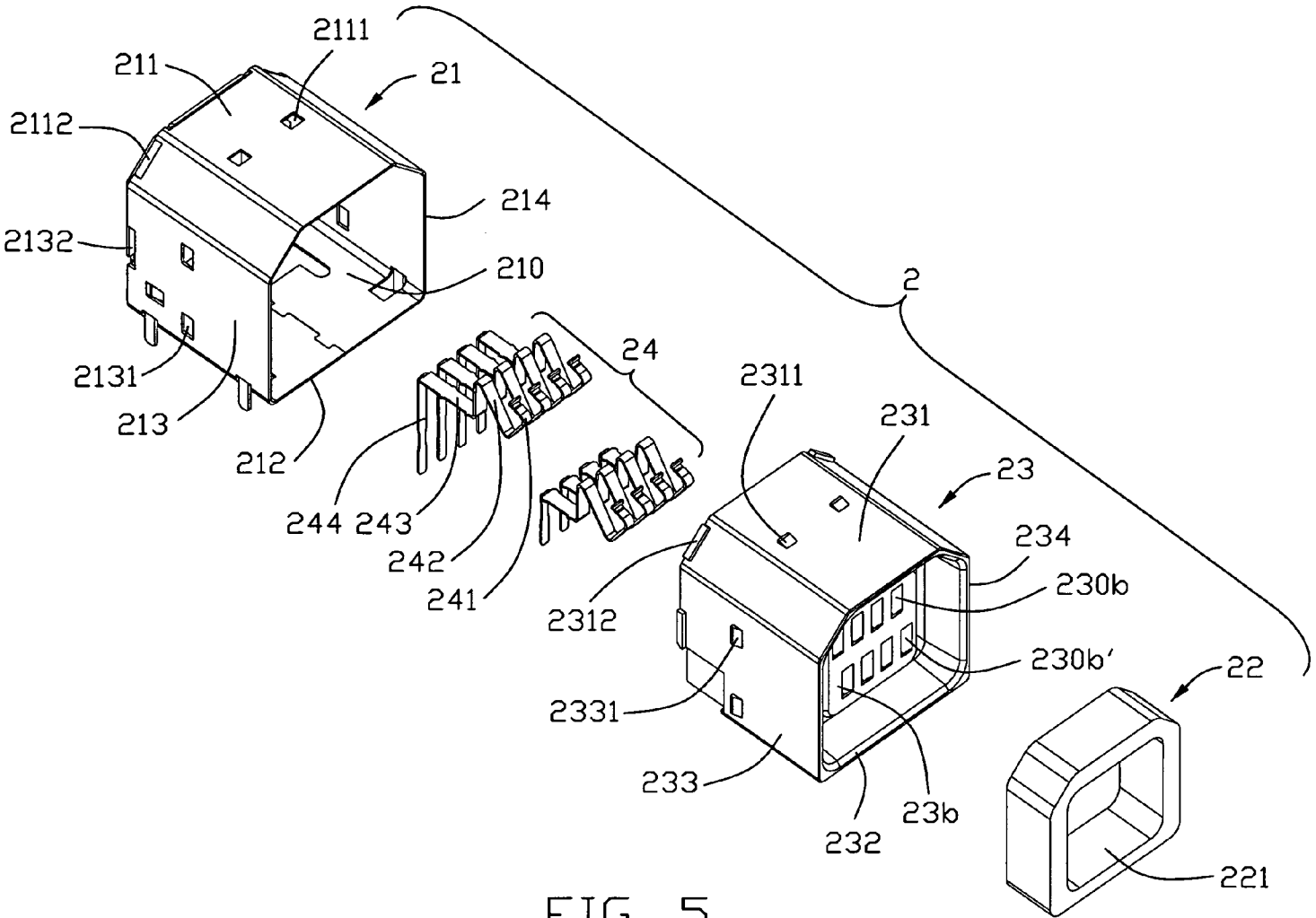
FIG. 5 is an exploded, perspective view of the receptacle connector for the electrical interconnection system in accordance with the present invention.
Figure 6:
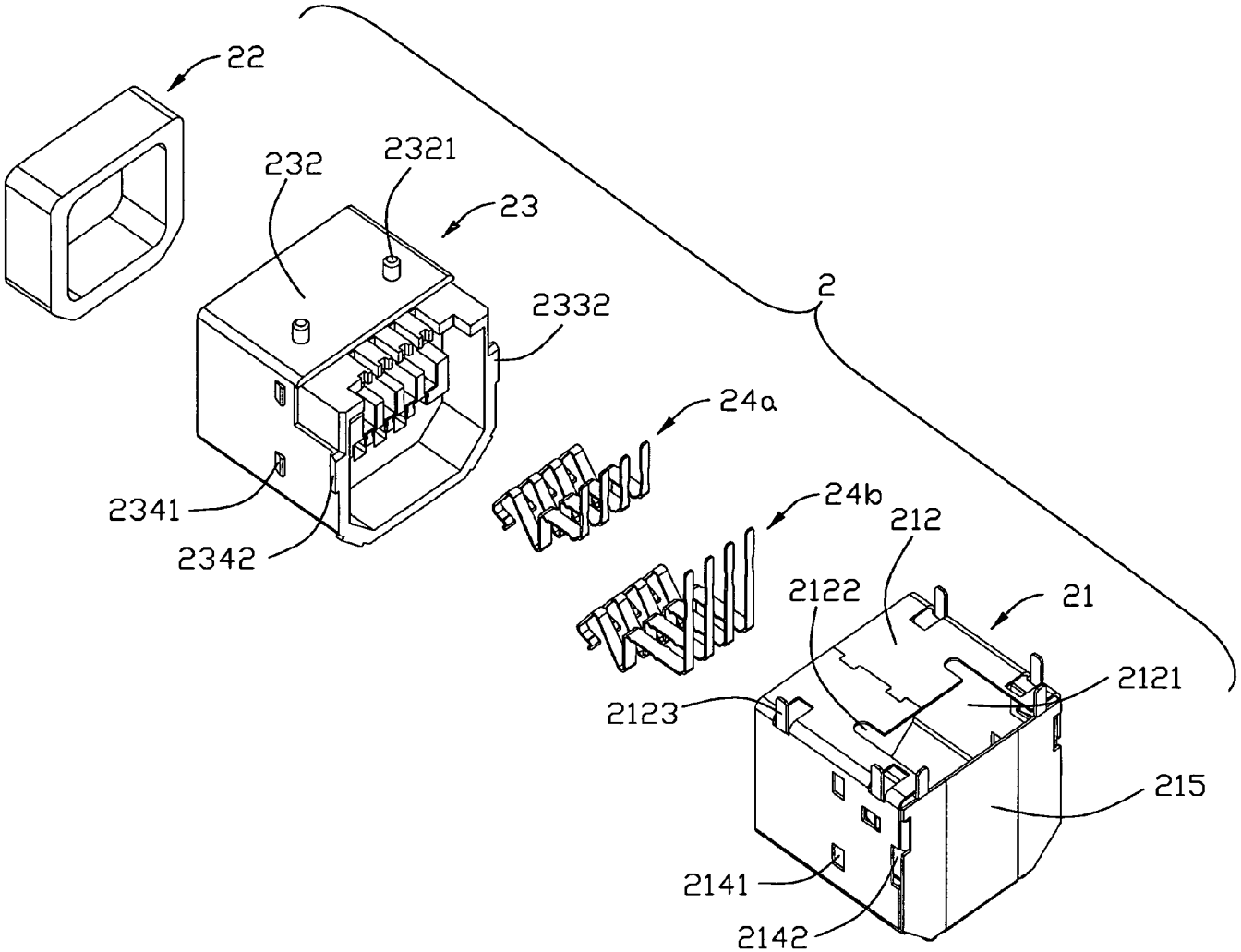
FIG. 6 is a view similar to FIG. 5, but viewed from another aspect.
Figure 7:
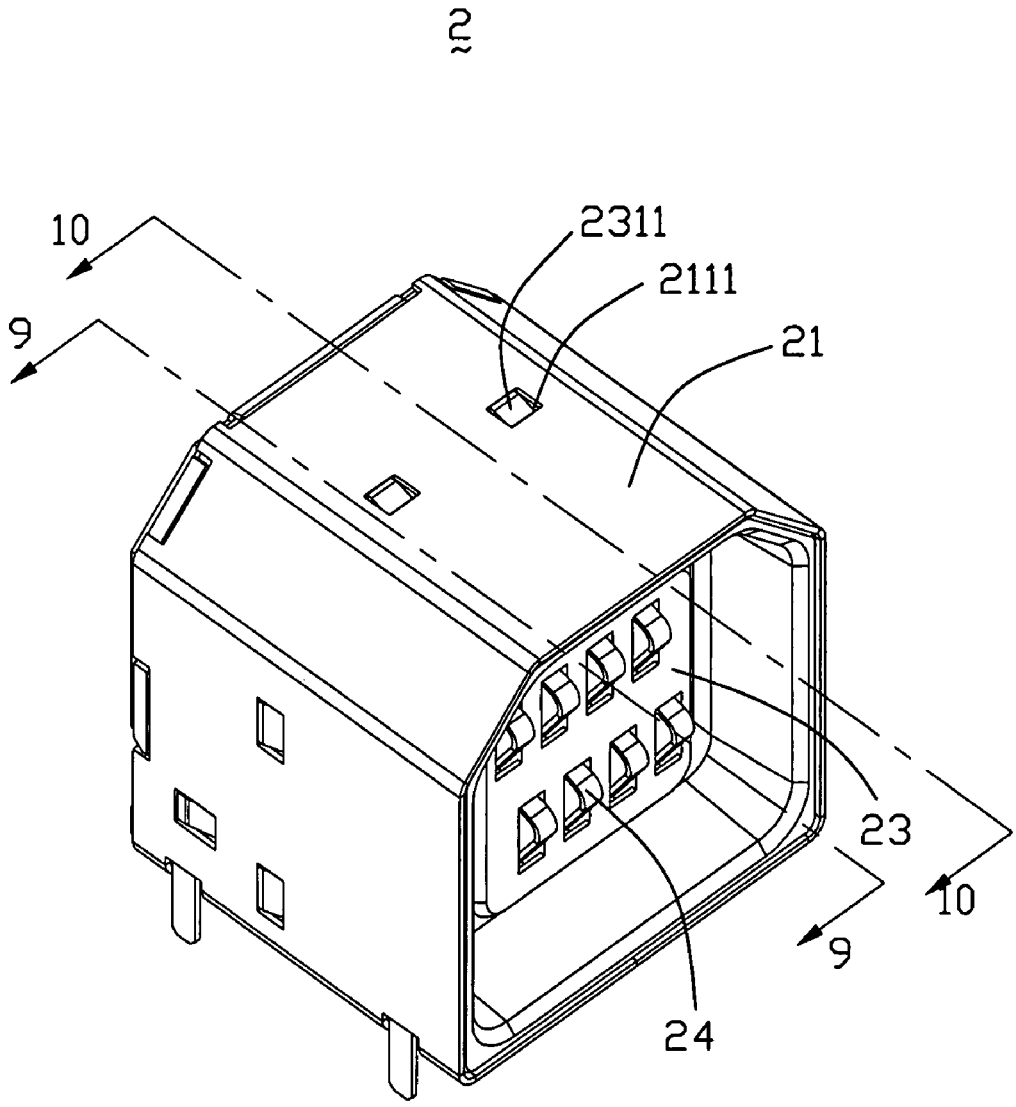
FIG. 7 is an assembled, perspective view of the receptacle connector shown in FIG. 5.
Figure 8:
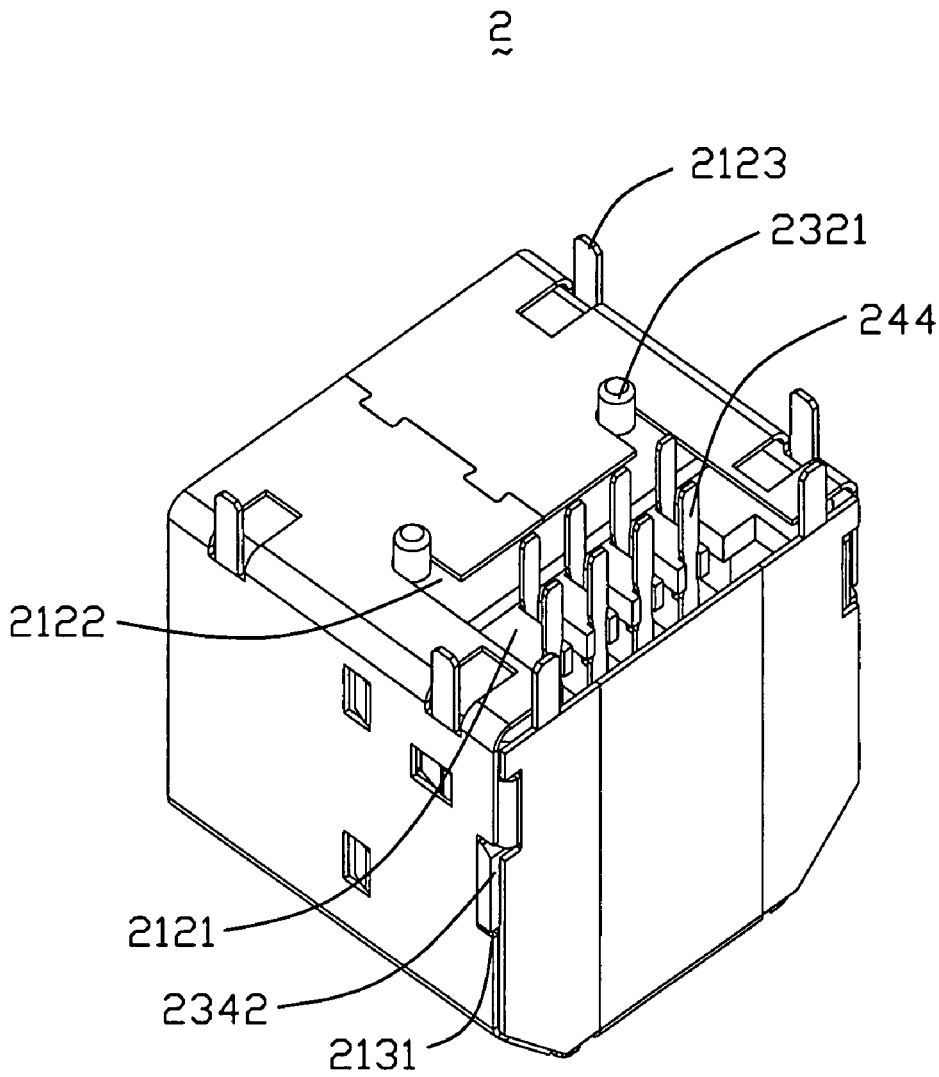
FIG. 8 is a view similar to FIG. 7, but viewed from another aspect.
Figure 9:
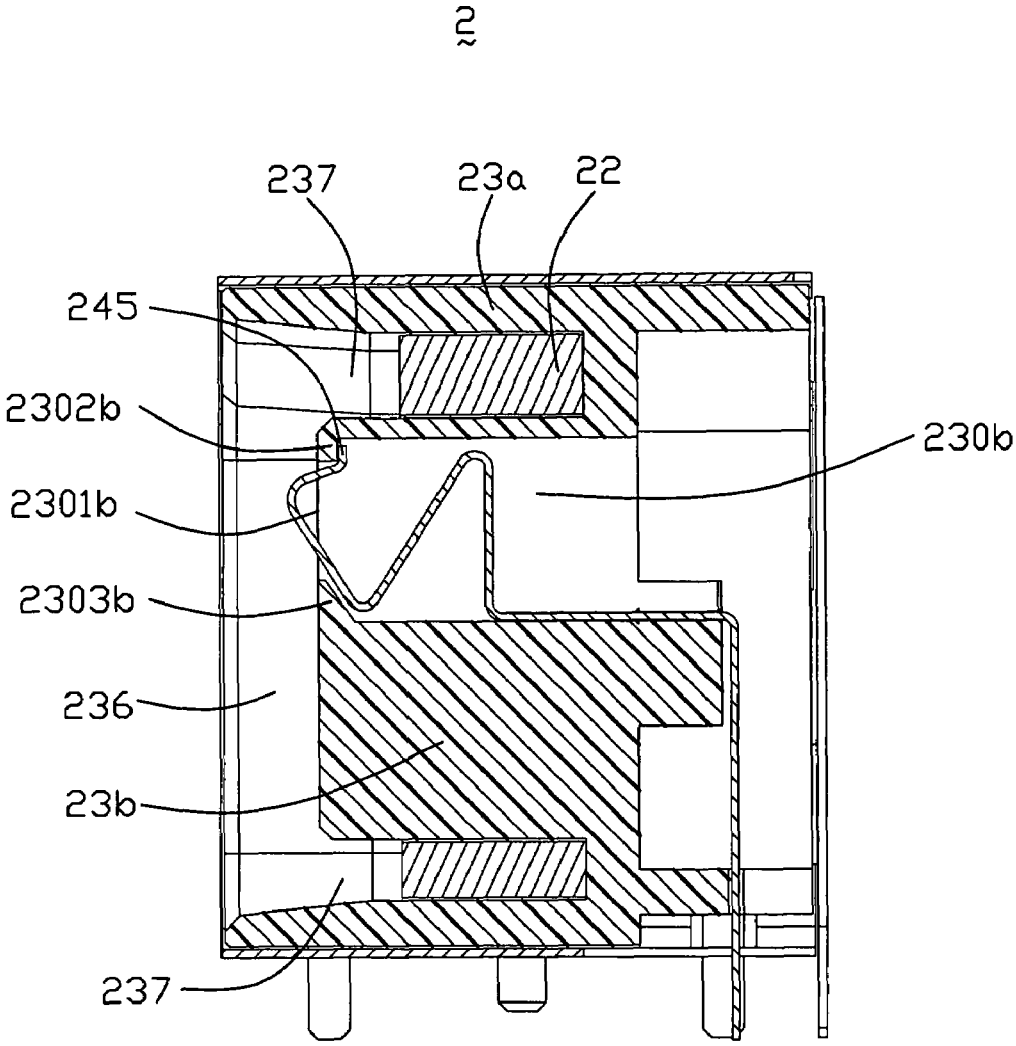
FIG. 9 is a cross-section view taken along line 9-9 of FIG. 7.
Figure 10:
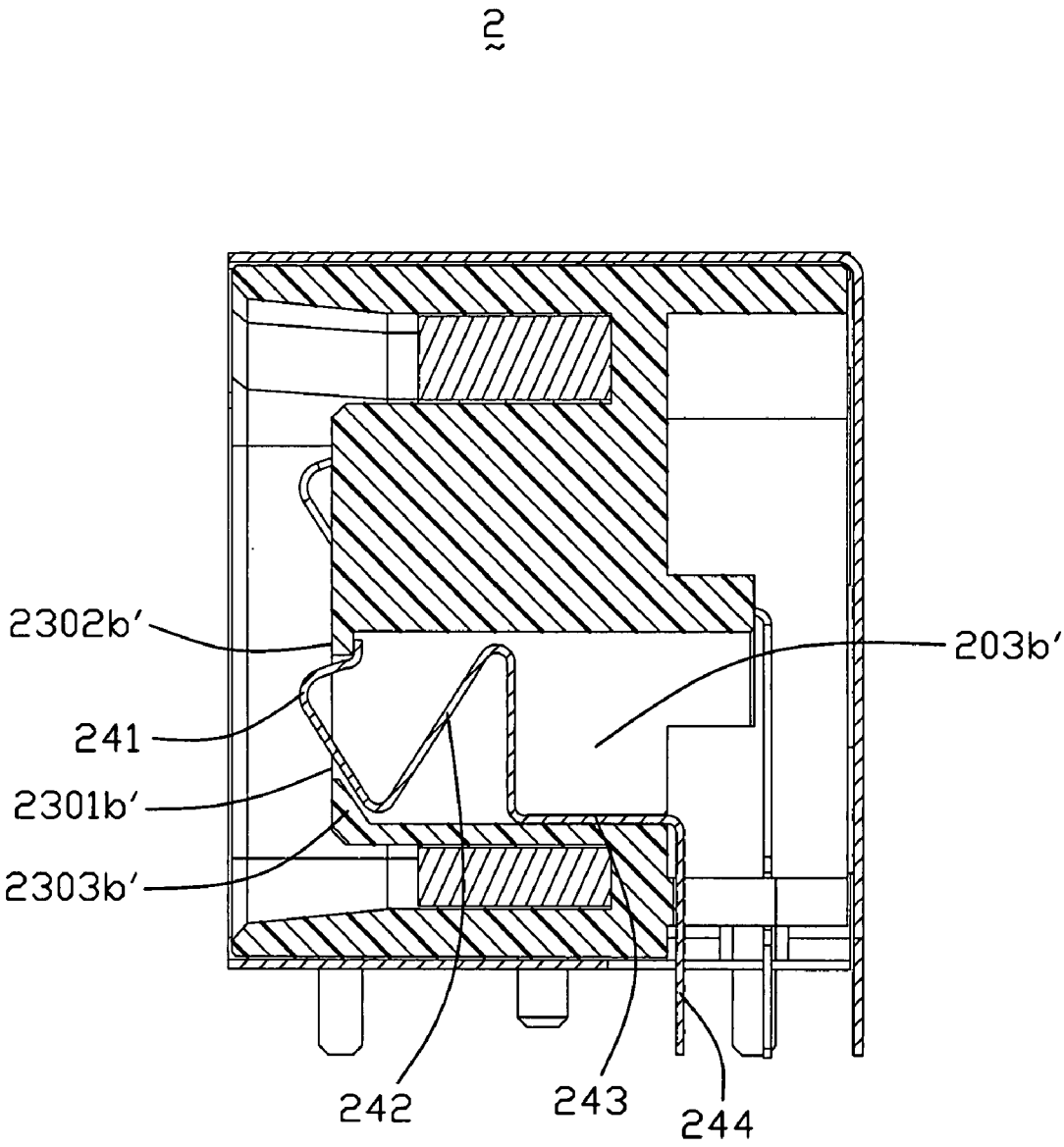
FIG. 10 is a cross-section view taken along line 10-10 of FIG. 7.

Referring to FIGS. 3 and 7, an electrical interconnection system comprises a plug connector 1 and a receptacle connector 2. The plug connector 1 and the receptacle connector 2 are coupled together via magnetic attraction therebetween.

Referring to FIGS. 1-4, the plug connector 1 comprises an insulated housing 13, a number of terminals 12 received in the insulated housing 13, an attraction member 11 shielding the insulated housing 13, a cable 16 electrically connecting to the terminals 12 and an insulator 15 partially over molded on the attraction element 11, the cable 16 and the insulated housing 13.

The attraction member 11 is made of permanent magnet or ferromagnetic materials. The attraction member 11 comprises a top wall 111, a bottom wall 112 and a pair of transversal walls 113, 114 to corporately form a hollow portion 110 therebetween. The pair of the transversal walls 113, 114 further have two vertical protrusion members 115 located at rear section thereof. Both the top wall 111 and the bottom wall 112 define a pair of first through holes 1111, 1122 aligning with each other.

The insulated housing 13 comprises a substantially rectangular-shaped body portion 131, a flange portion 132 encircling along an outside surface of a rear part of the body portion 131 and a planar spacer 133 extending rearward from a middle section of back surface of the body portion 131. The body portion 131 defines a number of terminal passages (not numbered) separated into a set of first terminal passages 131*a* and another set of second terminal passages 131*b* at different levels. The set of first terminal passages 131*a* and the set of the second terminal passages 131*b* offset from one another along vertical direction. The set of first terminal passages 131*a* are arranged above an imaginary horizontal plane (not shown) through a central section of the spacer 133, while the set of second terminal passages 131*b* are arranged below the imaginary horizontal plane. Each first terminal passage 131*a* comprises a vertical mounting grooves 1311 recessed rearward from forward surface of the body portion 131, a first positioning cavity 1312 and a second through positioning cavity 1313 respectively extend interiorly from a lower portion and an upper portion of each mounting groove 1311. The second terminal passage 131*b* is same as the first terminal passage 131*a*, excepted that a first position cavity (not numbered) is located above the second positioning cavity (not numbered) of the second terminal passage 131*b*. A pair of second through holes 1314 passing a top and a bottom surfaces of the body portion 131 are located at lateral sides of the body portion 131 and adjacent to the flange portion 132. The body portion 131 received in the hollow portion 110 of the attraction member 11, a rear surface of the attraction member 11 abuts against a front surface of the flange portion 132, the pair of first through holes 1111, 1122 align with the pair of second through holes 1314 to allow a pair of pin members 14 insert into therein, thus the insulated housing 13 and the attraction member 11 are combined together securely. The insulated housing 13 is interiorly received in the attraction member 11 to form a forward first mating space 1101 between a front section of the attraction member 11 and a front surface of the insulated housing 13.

The terminals 12 are separated into a set of first terminals 12*a* and another set of second terminals 12*b* respectively arranged along longitudinal direction and apart from one another vertically. The set of first terminals 12*a* and the set of second terminals 12*b* both have four terminals, however, it should be noted that the number of the set of the first terminals 12*a* or 12*b* may more or less than that of the present embodiment, and either the set of first terminals 12*a* or the set of second terminals 12*b* should have no less than two terminals to form a clearly terminal set/row. The first terminal 12*a* is configured to hooked structure and comprises a vertical contact portion 121, a flat first retention portion 122 extending rearward from a lower end of the vertical contact portion 121, a flat second retention portion 123 extending rearward from an upper end of the vertical contact portion 121 and parallel to the first retention portion 122, and a tail portion 124 extending rearward from a rear end of the first retention portion 122. The contact portion 121 is located in corresponding mounting groove 1311, the first retention portion 122 is received in corresponding first retention cavity 1312, while the second retention portion 123 is received in corresponding second retention cavity 1313, and the tail portion 124 extending outward of the back surface of the body portion 131 and supported by the spacer 133. The second terminal 12*b* is same as the first terminal 12*a*, excepted that a first retention portion (not numbered) is located above the second retention portion (not numbered) of the second terminal 12*b*.

The cable 16 has a number of inner wires 161 soldered to corresponding tail portions 124 of the terminals 12, respectively. The insulator 15 is plastic material and over molded on a forward section of the cable 16, rear sections of the insulated housing 13 and the magnetic member 11.

Referring to FIGS. 5-10, the receptacle connector 2 adapted for mounting on a printed circuit board (not shown) comprises a metal shell 21, a magnetic block 22, and an insulative housing 23 and a number of spring contacts 24.

The insulative housing 23 comprises a peripheral portion 23*a* and a central body portion 23*b*. The central body portion 23*b* interiorly recesses from forward surface of the insulative housing 23 to form a first cavity 236. Partial of forward section of the central body portion 23*b* is cut to form compliant slot 237 communicating with the first cavity 236, in the present embodiment, the compliant slot 237 is of loop-shaped, however, other types of shape is available. The peripheral portion 23*a* has a top side 231, a bottom side 232, a pair of lateral sides 233, 234 joining to the top and bottom sides 231, 232. The top side 231 and pair of lateral sides 233, 234 respectively form a pair of tabs 2311, 2331, 2341 located at substantially central sections thereof. The top side 231 and pair of lateral sides 233, 234 further respectively form a pair of stoppers 2312, 2332, 2342 arranged at rear sections thereof. A pair of positioning posts 2321 are located at rear section of the bottom side 232. The central body portion 23*b* defines a set of first passageways 230*b* and another set of second passageways 230*b*' along vertical direction. The sets of the first passageways 230*b* and another set of second passageways 230*b*' offset from one another along vertical direction. The forward portion of the first and second passageway 230*b*, 230*b*' define a front opening 2301*b*, 2301*b*' respectively. A stopper member 2302*b*, 2302*b*' respectively located at upper portion of the front opening 2301*b*, 2301*b*', and a wedge-shaped protrusion member 2303*b*, 2303*b*' respectively arranged beneath the front opening 2301*b*, 2301*b*'.

The magnetic block 22 is configured to loop-shaped with a substantially rectangular-shaped passage 221 therein. When assembly, the magnetic block 22 is fitted into a back portion of the loop slot 237 of insulative housing 23, with a front section of the central body portion 23*b* surpassing a forward surface of the magnetic block 22.

The contacts 24 are separated into a set of first contacts 24*a* and another set of second contacts 24*b* respectively arranged along longitudinal direction and apart from one another vertically. The first contact 24*a* is substantially identical with the second contact 24*b*, except for little difference at dimension thereof. The first contact 24*a* is configured to spring-type and comprises a V-shaped mating segment 241 with a contacting portion (not numbered) forward extending outside of the front opening 2301*b* and protruding into the first cavity 236, a horizontal retention segment 243 inserted molded with and retained in the central body portion 23*b*, a substantially inverted V-shaped body segment 242 cantilevered in the first passageway 230*b* connecting the mating segment 241 and the retention segment 243, and a tail segment 244 disposed outward of a rear surface of the central body portion 23*b* and further bent downward from a rear end of the retention segment 243. A free end 245 of the first contact 24*a* abuts against the stopper member 2302*b*. The second contact 24*b* is assembled to the second passageway 230*b*', with same manner as aforementioned process. The tail segments 244 of the set of second contacts 24*b* are disposed forward of these of the set of first contacts 24*a*. The contacts 24 are configured to spring-type which can ensure a better electrical connection between the plug connector 1 and the receptacle connector 2.

The metal shell 21 has a substantially same profile as that of the insulative housing 23, and it has a top wall 211, a bottom wall 212, a pair of lateral walls 213, 214 joining to the top and bottom walls 211, 212 to form a roomage 210. The metal shell 21 further has a back wall 215 engages with end edge of the top wall 211. The top wall 211 and pair of lateral walls 213, 214 respectively define a pair of through holes 2111, 2131, 2141 located at substantially central sections thereof. The top wall 211 and pair of lateral walls 213, 214 further respectively define a pair of cutouts 2112, 2132, 2142 arranged at rear sections thereof. A rear section of the bottom wall 212 forms a window portion 2121 and a pair of spaced cutouts 2122 in front of and communicating with the window portion 2121. A number of board locks 2123 are disposed at margin areas of the bottom wall 212. The insulative housing 23 is assembled into roomage 210 of the metal shell 21 along front-to-back direction, with the tabs 2311, 2331, 2341 inserted into through holes 2111, 2131, 2141, the stoppers 2312, 2332, 2342 abut against cutouts 2112, 2132, 2142, the tail segments 244 of the contacts 24 and the positioning posts 2321 protruding outward via the window portion 2121 and the cutouts 2122 of the bottom wall 212.

Please referring to FIGS. 3, 4, 7, 9 and 10, when the plug connector 1 mates with the receptacle connector 2, the front section of central body portion 23*b* of the insulative housing 23 inserts into the forward first mating space 1101 of the attraction member 11 of the plug connector 1, while the front section of the attraction member 11 is inserted into a front portion of the loop slot 237 of insulative housing 23 proximate to the magnetic block 22, and such configurations may ensure the plug connector 1 and the receptacle connector 2 mating with other properly and reliably. Further more, the mating segment 241 of the contact is deflectable/moveable along mating direction (front-to-back direction); thus, a wiping/friction among the contacts 24 of the receptacle connector 2 and the terminals 12 of the plug connector 1 to eliminate dust or other materials which may effect reliable electrical connection therebetween, thus the plug connector 1 and the receptacle connector 2 may connect together more better.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

What is claimed is:

1. An electrical interconnection system, comprising:

a plug connector including:

an insulated housing;

a number of terminals received in the insulated housing, said terminals arranged in two rows, each terminal of the plug connector having a mating portion fixed to the insulated housing;

an attraction member assembled to the insulated housing; and a receptacle connector mated to the plug connector, including:

an insulative housing;

a number of contacts received in the insulated housing, said contacts arranged in two rows, mating with the terminals of the plug connector respectively, each contact of the receptacle connector having a mating segment deflectable along a mating direction;

a magnetic block assembled to the insulative housing; and wherein the plug connector and the receptacle connector are securely coupled together via a magnetic attraction between the magnetic member and the attraction member thereof.

2. The electrical interconnection system as claimed in claim 1, wherein a front segment of the attraction member forwardly protrudes beyond a front surface of the insulated housing of the plug connector, wherein the insulative housing of the receptacle connector defines a compliant slot recessed inward from front surface thereof, with the magnetic block located within the slot, and wherein the front segment of the attraction member is received in the compliant slot, proximate to the magnetic block.

3. The electrical interconnection system as claimed in claim 1, wherein the insulated housing of the plug connector has a body portion and a planar spacer extending rearward from a middle section of back surface of the body portion.

4. The electrical interconnection system as claimed in claim 3, wherein the insulated housing defines a number of terminal passages including a set of first terminal passages arranged above an imaginary horizontal plane through a central section of the spacer, a set of second terminal passages arranged below the imaginary horizontal plane.

5. The electrical interconnection system as claimed in claim 4, wherein the set of first terminals offset from the set of second terminals along vertical direction.

6. The electrical interconnection system as claimed in claim 4, wherein both the first terminal passage and the second terminal passage have vertical mounting grooves recessed rearward from forward surface of the body portion, a first positioning cavities respectively extending interiorly from a lower portion and an upper portion of mounting groove.

7. The electrical interconnection system as claimed in claim 6, wherein the terminals includes a first terminals and the second terminals, wherein both first terminals and the second terminals include vertical contact portions disposed in the vertical mounting grooves, first retention portions disposed in the first position cavities, tail portions extending beyond a back surface of the insulated housing and arranged on an upper and a lower surfaces of the spacer respectively.

8. A receptacle connector for an electrical interconnection system comprising:

a metal shell defining a roomage;

an insulative housing received in the roomage of the metal shell;

a number of contacts received in the insulated housing, the contacts being separated into two distinct sets; and a magnetic block assembled to the insulative housing adapted for attracting a plug connector.

9. The receptacle connector as claimed in claim 8, wherein the insulative housing includes a peripheral portion and a central body portion, with a loop-shaped compliant slot formed therebetween.

10. The receptacle connector as claimed in claim 9, wherein the magnetic block is configured to loop-shaped and fitted into the compliant slot of the insulative housing.

11. The receptacle connector as claimed in claim 10, wherein the central body portion interiorly recesses from forward face of the insulated housing to form a first cavity, wherein the first cavity communicates with the compliant slot.

12. The receptacle connector as claimed in claim 11, wherein the central body portion defines a number of passageways separated into distinct sets along vertical direction.

13. The receptacle connector as claimed in claim 12, wherein the contact is configured to spring-type and comprises a mating segment forward extending outside of the passageway and protruding into the first cavity, a horizontal retention segment inserted molded with and retained in the central body portion, a substantially inverted V-shaped body segment cantilevered in the passageway and a tail segment disposed outward of a rear surface of the central body portion and further bent downward from a rear end of the retention segment.

14. The receptacle connector as claimed in claim 8, wherein the metal shell has a top wall, a bottom wall, a pair of lateral walls joining to the top and bottom walls to form the roomage to receive the insulative housing therein.

15. The receptacle connector as claimed in claim 14, wherein the metal shell has at least one through hole defined in either the top wall or the pair of lateral walls to allow corresponding tab formed on a top side or the pair of lateral sides of the insulative housing inserting therein.

16. The receptacle connector as claimed in claim 14, wherein a rear section of a top side or the pair of lateral sides of the insulative housing forms at least one stopper to abut against corresponding cutout defined in rear section of either the top wall or the pair of lateral walls of the metal shell.

17. The receptacle connector as claimed in claim 14, wherein a rear portion of the bottom wall of the metal shell defines a window to allow tail segments of the contacts passing through.

18. An electrical connector assembly, comprising:

a first connector including:

a first insulative housing enclosing a plurality of first contacts and enclosed in a first metallic shell;

a second connector including:

a second insulative housing enclosing a plurality of second contacts and enclosed in a second metallic shell; wherein one of said first connector and said second connector includes a magnetic structure, and either said first contacts or said second contacts provides a resilient force to buffer mating between the first connector and the second connector due to a magnetic force generated by said magnetic structure of said one connector, and applied to the other connector.

19. The connector as claimed in claim 18, wherein said magnetic structure and the contact providing the resilient force belong to the same connector.

* * * * *